US006737597B1

(12) United States Patent
Galpchian

(10) Patent No.: US 6,737,597 B1
(45) Date of Patent: May 18, 2004

(54) SNAP ACTION SUMP PUMP SWITCH

(75) Inventor: Levon Galpchian, Cranston, RI (US)

(73) Assignee: Tower Manufacturing Corporation, Providence, RI (US)

( * ) Notice: Subject to any disclaimer, the term of this patent is extended or adjusted under 35 U.S.C. 154(b) by 6 days.

(21) Appl. No.: 10/138,684

(22) Filed: May 3, 2002

(51) Int. Cl.[7] ..... H01H 5/00
(52) U.S. Cl. ..... 200/405; 200/406; 200/408
(58) Field of Search ..... 200/405, 406, 200/407, 408, 409

(56) References Cited

U.S. PATENT DOCUMENTS

| | | | |
|---|---|---|---|
| 3,585,544 | A | 6/1971 | Cleaveland |
| 3,740,500 | A | 6/1973 | Garrett et al. |
| 3,783,811 | A | 1/1974 | Schmedding et al. |
| 3,887,848 | A | 6/1975 | Larson et al. |
| 3,914,564 | A | 10/1975 | Reed et al. |
| 3,937,981 | A | 2/1976 | Nystuen et al. |
| 3,981,611 | A | 9/1976 | Jensen |
| 3,993,988 | A | 11/1976 | Walter |
| 3,996,436 | A | 12/1976 | Barney |
| 4,021,628 | A | 5/1977 | Kimblin |
| 4,023,885 | A | 5/1977 | Snowdon et al. |
| 4,179,676 | A | 12/1979 | Selas |
| 4,196,325 | A | 4/1980 | Povilaitis |
| 4,200,105 | A | 4/1980 | Gonser |
| 4,233,480 | A | 11/1980 | Hruda |
| 4,314,121 | A | 2/1982 | Gaber |
| 4,324,961 | A | 4/1982 | Ristuccia |
| 4,476,355 | A | 10/1984 | Mital |
| 4,916,274 | A | 4/1990 | Hawley et al. |
| 5,471,024 | A | 11/1995 | Ross et al. |
| 5,998,749 | A | 12/1999 | Stockmaster et al. |
| 6,051,800 | A | 4/2000 | Barrett |

*Primary Examiner*—Elvin G. Enad
*Assistant Examiner*—K. Lee
(74) *Attorney, Agent, or Firm*—Kriegsman & Kriegsman

(57) ABSTRACT

A sump pump switch for controlling the application of power from a power source to a sump pump motor in response to the rise and fall of a liquid collecting in a sump includes a housing, a pair of electrically conductive terminal members fixedly disposed within the housing and a pair of electrically conductive contact members fixedly disposed within the housing. A pair of electrically conductive movable contacts are mounted onto a contact bridge. The contact bridge is pivotally disposed within the housing and is actuated by an over-center mechanism. The movable contacts are pivotally coupled to the terminal members and selectively contact the contact members to effectively close the switch. A pair of electrically conductive wiper contacts connect the terminal members with the contact members and provide a non-articulating current path between the terminal members and the contact members.

25 Claims, 7 Drawing Sheets

SNAP ACTION SUMP PUMP SWITCH

BACKGROUND OF THE INVENTION

The present invention relates generally to electrical switches and more particularly to snap action, sump pump switches.

A sump is a pit or well in which liquids collect. The rise and fall of liquid in sumps occurs at unpredictable rates.

A sump pump is commonly used to regulate the amount of liquid which collects within a sump. Specifically, a sump pump can be used to decrease the amount of liquid which accumulates within a sump.

It should be noted that a sump pump may be manually activated, as deemed necessary by the operator, in order to decrease the amount of liquid which accumulates within a sump. However, the manual activation of a sump pump can be very labor intensive, which is highly undesirable.

As a result, sump pump switches (also commonly referred to as float switches) are well known and widely used in the art to control the activation of a sump pump motor in response to the rise and fall of the amount of liquid which collects within a sump. Sump pump switches commonly use a float to monitor the level of liquid which accumulates within the sump. The float, in turn, is connected to a pivotally mounted, switch operating lever. The switch operating lever draws electrical contacts into and out of engagement so as to selectively power the sump pump motor, as will be described further in detail below.

A snap action sump pump switch (also commonly referred to as an over-center spring sump pump switch) is one well-known type of sump pump switch. In a snap action sump pump switch, the switch opening and closing movements, quite desirably, occur with a defined snap. The provision of snap action switching minimizes arcing conditions between the contacts and thereby prolongs switch life, which is highly desirable.

In U.S. Pat. No. 4,196,325 to S. A. Povilatis, there is disclosed a snap action sump pump switch (hereinafter referred to as the Povilatis switch) which selectively connects a power source with a sump pump motor. The Povilatis switch includes a housing which is constructed of a molded, electrically insulated plastic. The housing is shaped to define an interior space, or depression, into which the various switch components are disposed. Such components include a pair of terminal members which are fixedly mounted onto the housing and which are externally accessible for connection to the power source. A pair of contact members are fixedly mounted onto the housing and are electrically connected to the sump pump motor, such as through a pair of insulated, flexible electrical wires. A generally U-shaped, electrically insulated contact bridge, or yoke, is pivotally disposed within the interior space of the housing. A pair of electrically conductive movable contacts are pivotally mounted onto parallel extending, spaced apart arms of the yoke and are capable of relative lateral movement. An over-center mechanism is provided to pivotally move the yoke (and, as a consequence, the movable contacts mounted on the yoke) between two positions. The over-center mechanism includes an actuator arm, or operating lever, which is pivotally mounted onto the housing. A pivot bushing and a coiled spring together serve to connect one end of the actuator arm to the yoke.

It should be noted that each of the pair of electrically conductive movable contacts is drawn in continuous contact with an associated, electrically conductive, terminal member, thereby establishing an electrical current path between each terminal member and its corresponding movable contact. Specifically, each movable contact includes a pair of oppositely disposed, outwardly projecting tabs on side edges of a rear end portion thereof. The pair of tabs on each movable contact align in contact within a pair of triangularly shaped, rearwardly opening notches formed in the rear edge portions of its associated terminal member. The notches on each terminal member serve as a fulcrum about which its associated movable contact reciprocally pivots thereagainst when actuated between first and second switch positions.

In use, the Povilatis switch functions in the following manner to control the activation of a sump pump. The terminal members of the switch are electrically connected to the power source and the contact members of the switch are electrically connected to the sump pump. A float is mounted onto the free end of the actuating arm and remains on the top surface of the liquid accumulating in the sump.

Once the surface of the liquid rises to a predetermined level, the float pivots the actuating arm in such a manner so that the over-center mechanism pivots the yoke, thereby drawing the movable contacts mounted on the yoke into electrical engagement with the fixed contacts. The electrical engagement between the movable contacts and the fixed contacts establishes a current path from the power source, through the terminal members, through the movable contacts, through the fixed contact members and into the sump pump motor, thereby energizing and activating the sump pump motor.

To the contrary, as the surface of the liquid falls, the float pivots the actuating arm in the opposite direction so that the over-center mechanism, in turn, pivots the yoke in the opposite direction, thereby disengaging the movable contacts from electrical contact with the fixed contacts. The electrical disengagement between the movable contacts and the fixed contacts opens the current path between the source of power and the sump pump motor, thereby de-activating the sump pump motor.

Although well-known and widely used in commerce, the Povilatis switch suffers from a notable drawback in its design. Specifically, with the Povilatis switch disposed in either its closed position or its open position, a current path is established between the electrical terminal members and the movable contacts through the four movable contact pivot points. As noted above, each movable contact includes a pair of oppositely disposed, outwardly projecting tabs on side edges of a rear end portion thereof. The pair of tabs on each movable contact align in contact within a pair of triangularly shaped, rearwardly opening notches formed in the rear edge portions of its associated terminal member. The notches on each terminal member serve as a fulcrum about which its associated movable contact reciprocally pivots thereagainst when actuated between first and second switch positions. As can be appreciated, the fact that electrical current is required to travel through pivot points, renders the Povilatis switch susceptible to many undesirable conditions which can decrease the life of the switch.

For example, the fact that electrical current is required to travel through the pivot points renders the switch susceptible to connection problems between each movable contact and its associated terminal member due to manufacturing tolerances in said components (e.g., burrs on the stamped parts), which is highly undesirable.

As another example, the fact that large amounts of electrical current are required to travel through the pivot points renders the switch susceptible to arcing conditions between the movable contacts and the electrical terminal members, which is highly undesirable. In fact, arcing conditions can wear the quality of the connection through the pivot points. As arcing in the pivot points deteriorates integrity of the connection, the contacts can become misaligned, thereby causing the switch ultimately lock up, or fail, which is highly undesirable.

SUMMARY OF THE INVENTION

It is an object of the present invention to provide a new and improved sump pump switch for controlling the starting and stopping of a sump pump motor in response to the rise and fall of the level of a liquid collecting in a sump.

It is another object of the present invention to provide a sump pump switch as described above which is of the snap action variety.

It is yet another object of the present invention to provide a sump pump switch as described above which does not require electrical current to travel through one or more pivot points.

It is still another object of the present invention to provide a sump pump switch as described above which is insusceptible to arcing conditions.

It is yet still another object of the present invention to provide a sump pump switch as described above may be mass produced, has a minimal number of parts, and can be easily assembled.

Accordingly, in one embodiment of the present invention, there is provided an electric switch comprising an electrically insulated housing, an electrically conductive terminal member disposed within said housing, an electrically conductive contact member disposed within said housing, an electrically conductive movable contact disposed in continuous pivotal contact with said terminal member, said movable contact selectively contacting said contact member, and an electrically conductive wiper contact disposed within said housing, said wiper contact being connected to said terminal member and to said movable contact.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
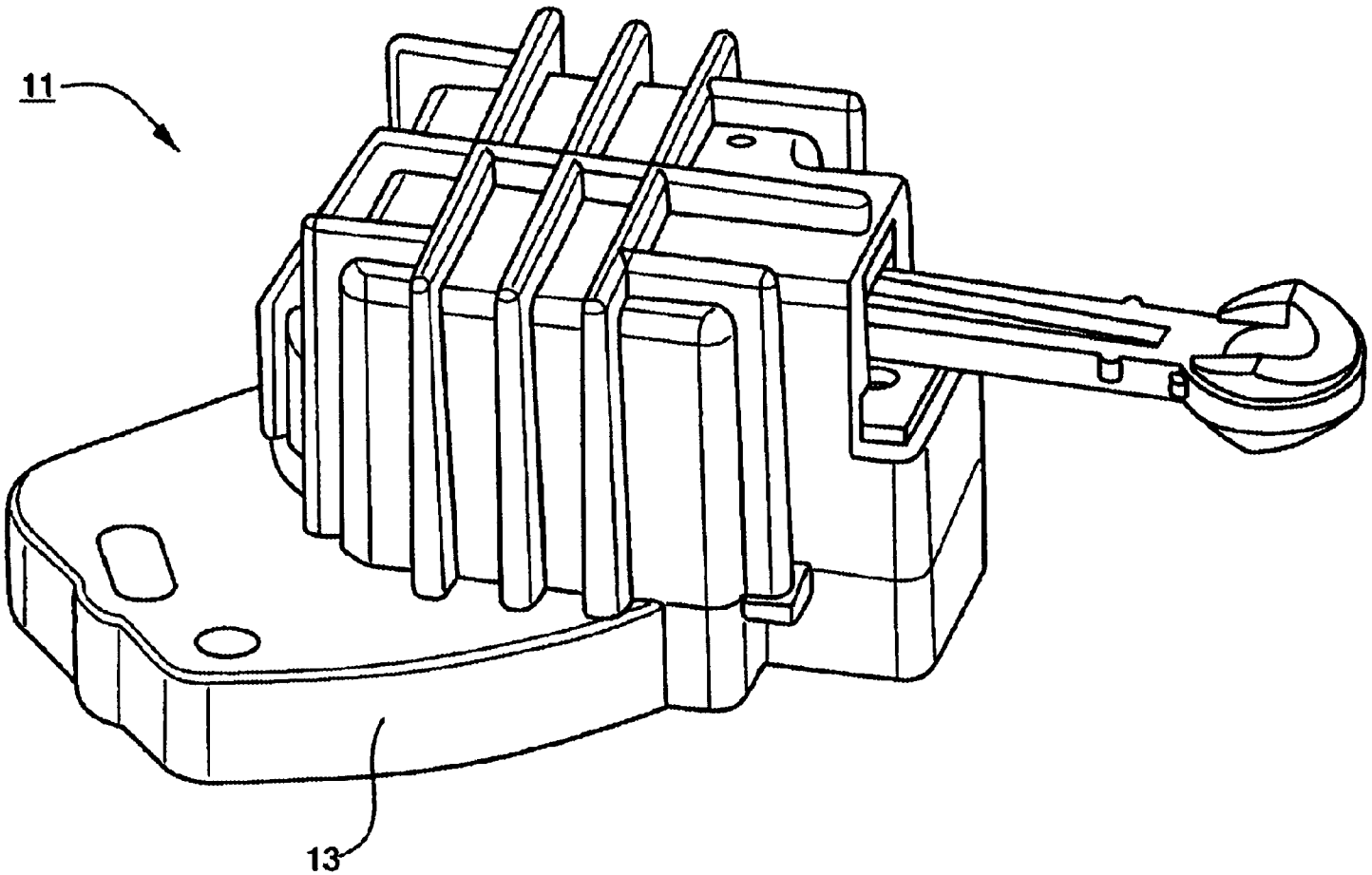
FIG. 1 is a top perspective view of a first embodiment of a sump pump switch constructed according to the teachings of the present invention.

Referring now to FIGS. 1–7, there is shown a first embodiment of a sump pump switch constructed according to the teachings of the present invention, the sump pump switch being represented generally by reference numeral 11. As will be described further below, sump pump switch 11 serves to control the application of power from a power source to a sump pump motor in response to the rise and fall of the level of a liquid collecting in a sump.

Switch 11 comprises a housing 13 which is preferably constructed of an electrically insulated plastic using conventional molding techniques. Housing 13 comprises a base 15 and a cover plate 17, cover plate 17 being adapted to be mounted onto base 15 using a rivet 18 or any other conventional fastening device, such as a screw. Together, base 15 and cover plate 17 define an interior cavity, or depression, 19 into which various components for switch 11 are disposed.

First and second terminal members 21-1 and 21-2 are disposed into interior cavity 19 in a spaced apart relationship, each terminal member 21 being fixedly mounted onto base 15.

Figure 3:
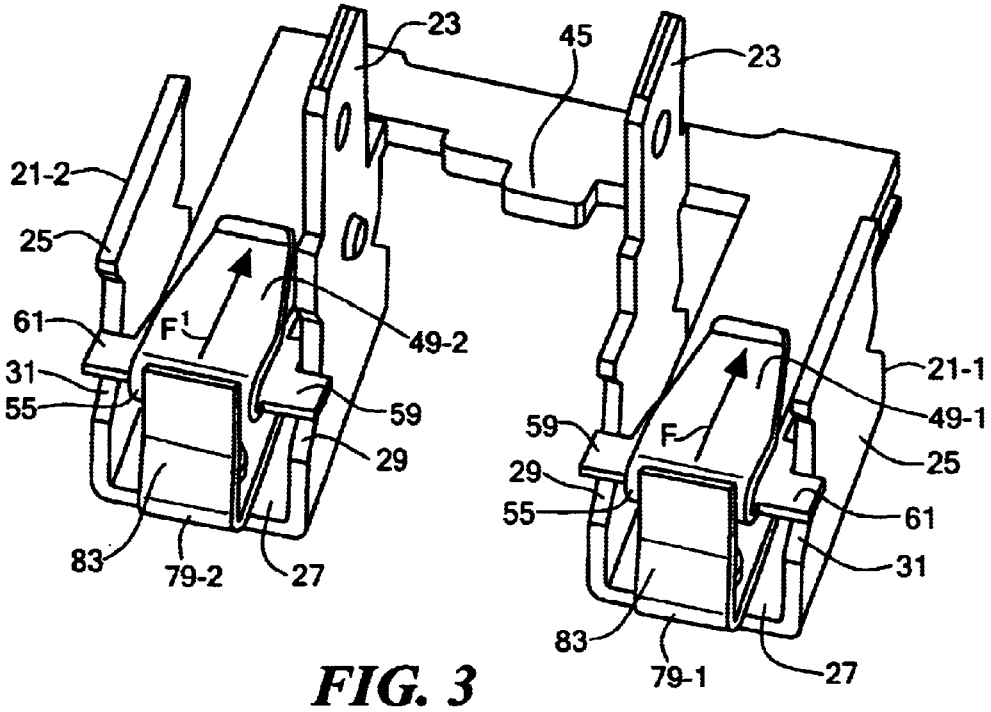
FIG. 3 is a bottom perspective view of the contact bridge, the pair of movable contacts, the pair of terminal members and the pair of wiper contacts shown in FIG. 2, the bridge, movable contacts, terminal members and wiper contacts being shown in their assembled form.
Figure 4:
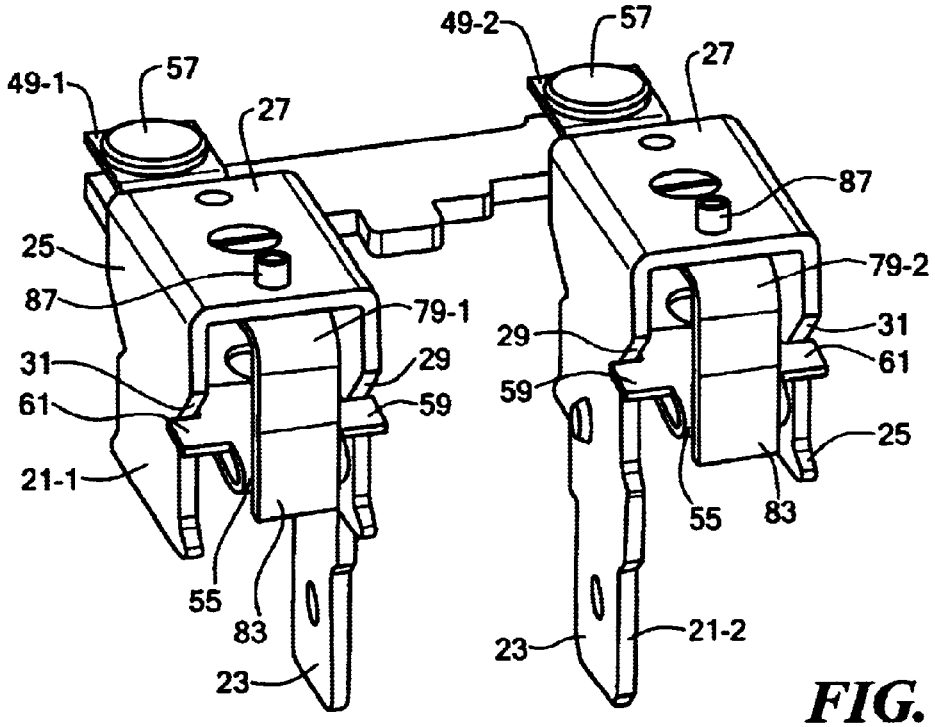
FIG. 4 is a top perspective view of the contact bridge, the pair of movable contacts, the pair of terminal members and the pair of wiper contacts shown in FIG. 2, the bridge, movable contacts, terminal members and wiper contacts being shown in their assembled form.

Each terminal member 21 is preferably constructed of metal and is formed into a generally U-shaped configuration, as seen most clearly in FIGS. 3 and 4. Specifically, each terminal member 21 includes a pair of contact arms 23 and 25 which are disposed in a spaced apart, parallel relationship, contact arm 23 being considerably longer in length than contact arm 25. It should be noted that contact arm 23 of each terminal member 21 is sized and shaped to extend through an associated slot formed in cover plate 17, thereby enabling each contact arm 23 to be externally accessible for connection to the power source.

Each terminal member 21 also includes a support arm 27 which connects contact arms 23 and 25. Support arm 27 is fixedly mounted onto the inner surface of base 15 using a conventional fastening device, such as a rivet or screw.

A triangularly-shaped, rearwardly opening notch 29 is formed into the rear edge of each contact arm 23. Similarly, a triangularly-shaped, rearwardly opening notch 31 is formed into the rear edge of each contact arm 25. As will be described further below, notches 29 and 31 serve as pivot points through which a pair of movable contacts are free to reciprocally pivot.

First and second fixed contact members 33-1 and 33-2 are disposed into interior cavity 19 in a spaced apart relationship, each contact member 33 being fixedly mounted onto base 15.

Figure 2:
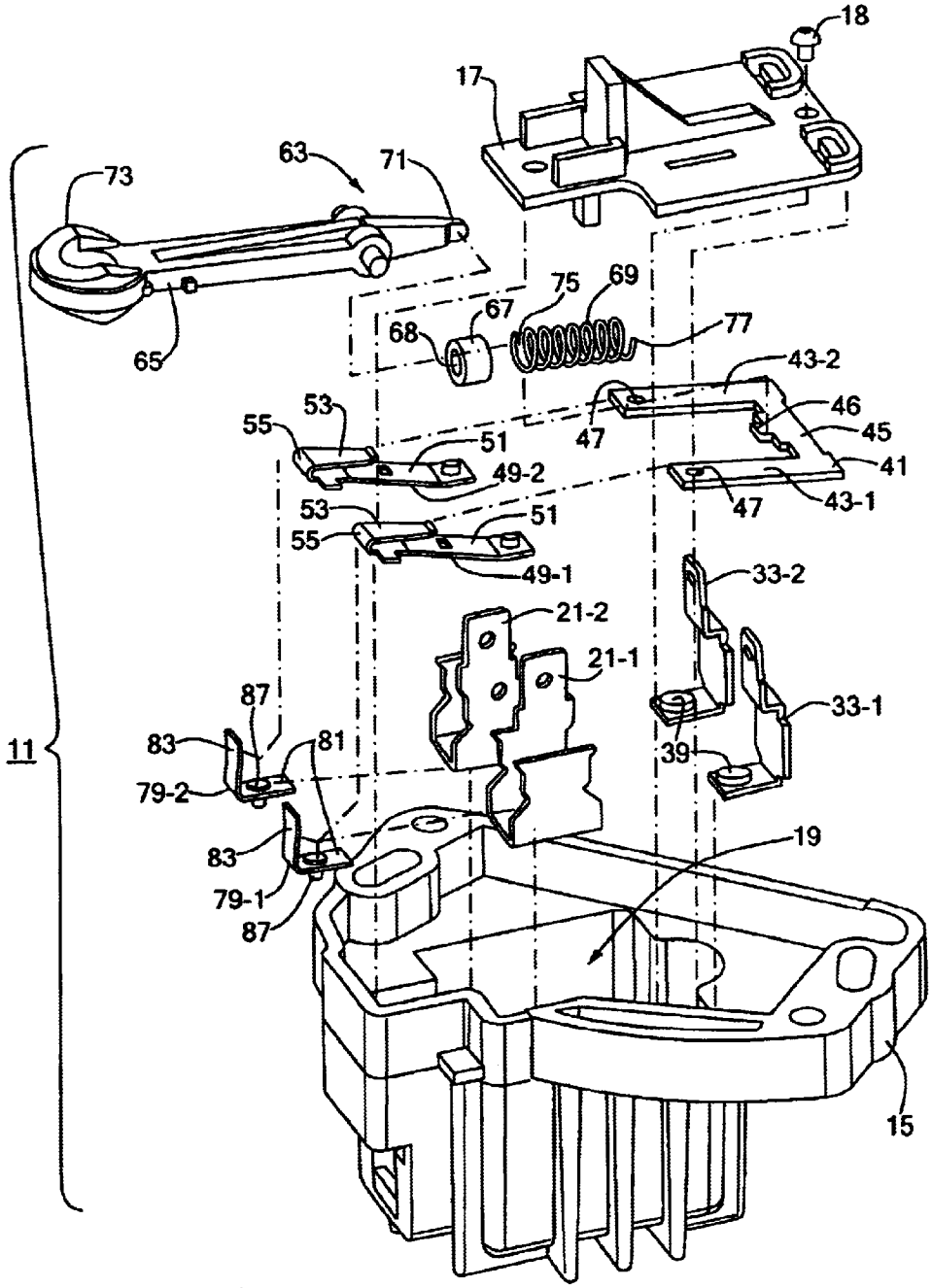
FIG. 2 is an exploded, bottom perspective view of the sump pump switch shown in FIG. 1.
Figure 5:
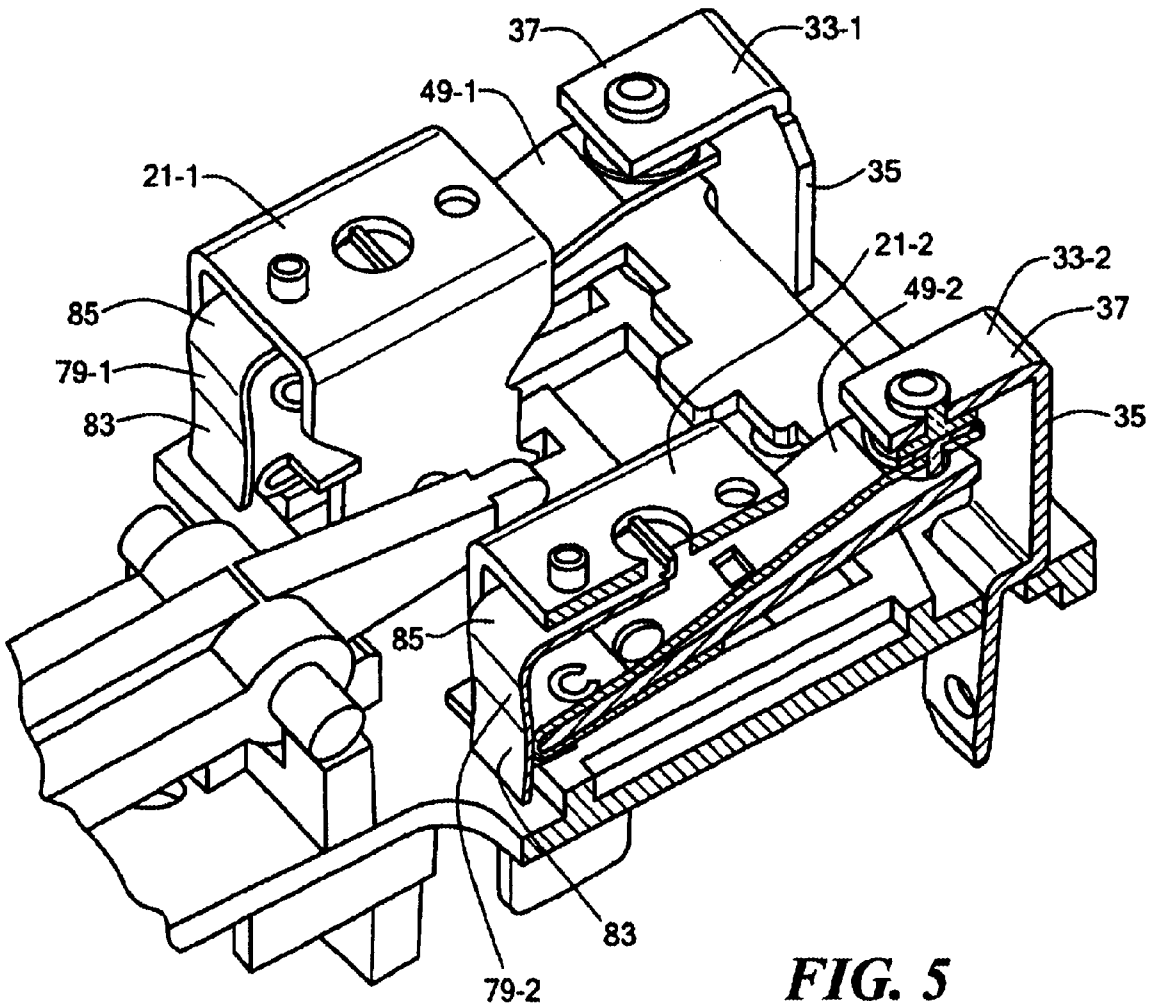
FIG. 5 is a fragmentary, top perspective section view of the sump pump switch shown in FIG. 1, the sump pump switch being shown with its housing, bushing and spring removed therefrom.
Figure 6:
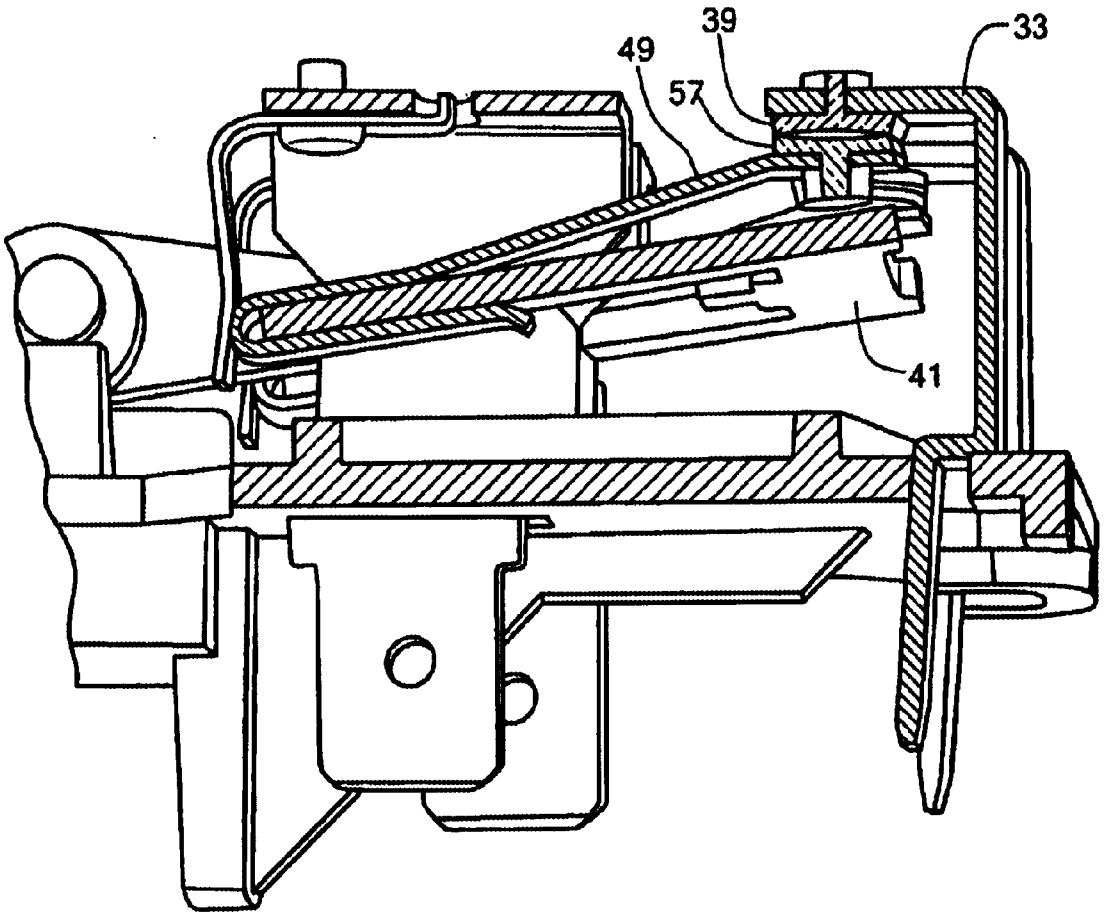
FIG. 6 is a fragmentary, side perspective section view of the sump pump switch shown in FIG. 1, the sump pump switch being shown with its housing, bushing and spring removed therefrom.
Figure 7:
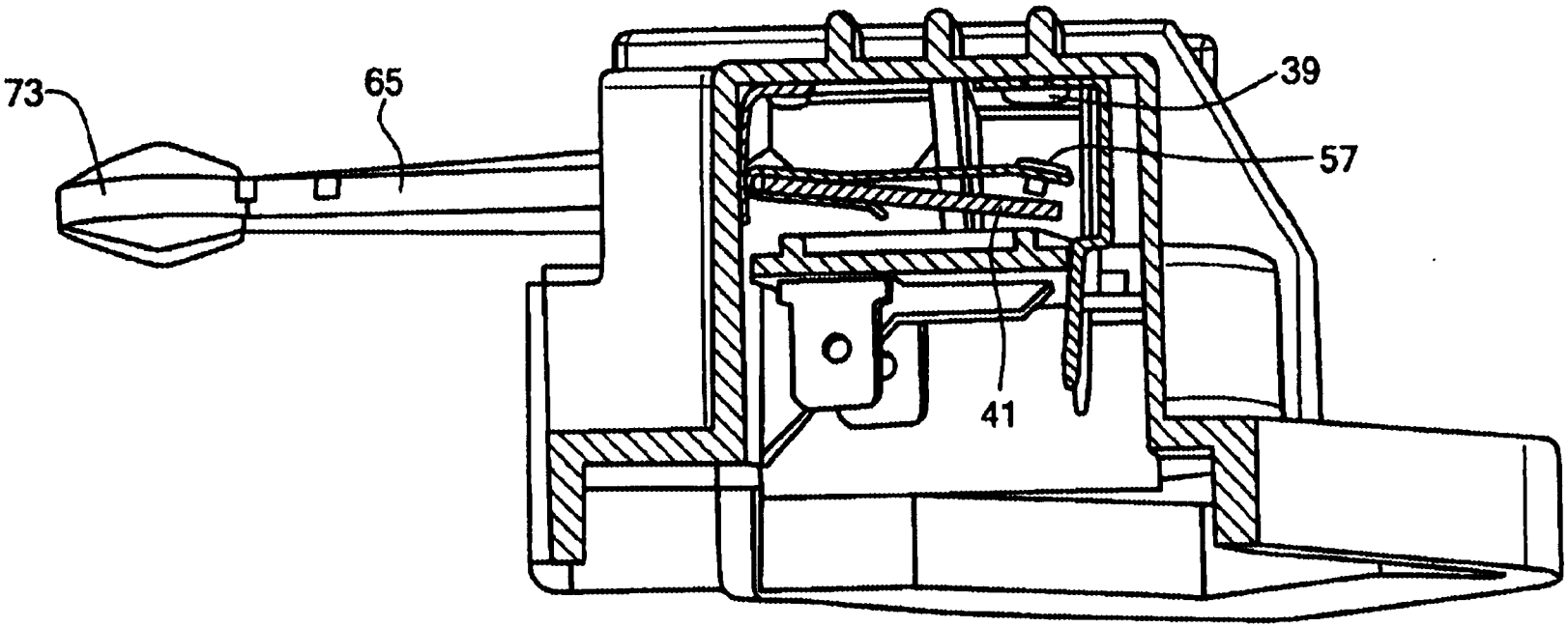
FIG. 7 is a side perspective section view of the sump pump switch shown in FIG. 1.

Each contact member 33 is preferably constructed of metal and is formed into a generally L-shaped configuration, as seen most clearly in FIGS. 2 and 5. Specifically, each terminal member 33 includes a substantially vertical contact arm 35 and a horizontal contact are 37 which are integrally formed together. Vertical contact arm 35 is sized and shaped to be slidably disposed into a corresponding slot which is integrally formed into base 15. The free end of each vertical contact arm 35 is slightly offset and is sized and shaped to extend through an associated slot formed in cover plate 17, thereby enabling each contact member 33 to be externally accessible for connection to the sump pump motor, such as through a pair of insulated, flexible wires. A contact button 39 is formed onto the inner surface of each horizontal contact arm 37, each contact button 39 serving as a point of electrical contact between each contact member 33 and an associated movable contact.

A generally U-shaped, electrically-insulated contact bridge, or yoke, 41 is pivotally disposed within interior cavity 19 of housing 13. As seen most clearly in FIG. 2, contact bridge 41 comprises a pair of parallel extending, spaced apart arms 43-1 and 43-2 which are joined together at their forward ends by a cross-member 45. Each arm 43 of contact bridge is shaped to define a round hole 47 proximate its distal end. As will be described further below, contact bridge 41 is capable of pivotal displacement between a first position and a second position.

First and second movable contacts 49-1 and 49-2 are pivotally mounted onto arms 43-1 and 43-2, respectively, of contact bridge 41.

Each movable contact 49 is an elongated, unitary, electrically conductive member which has a clip-on construction. As seen most clearly in FIGS. 2–4, each movable contact 49 is shaped to include an elongated pivot arm 51 and a clip arm 53 which are connected together about a bend 55. A contact button 57 is formed onto the top surface of each pivot arm 51 proximate its distal end. As can be appreciated, when contact bridge 41 is pivoted into its first position, each contact button 57 is drawn into selective contact with a corresponding contact button 39 on contact member 33, thereby establishing a current path between each movable contact 49 and its corresponding contact member 33. To the contrary, when contact bridge 41 is pivoted into its second position, each contact button 57 is drawn out of contact with its corresponding contact button 39 on contact member 33, thereby eliminating the current path between each movable contact 49 and its corresponding contact member 33.

Pivot arm 51 of each movable contact 49 is shaped to include first and second, oppositely disposed, outwardly projecting tabs 59 and 61. Tabs 59 and 61 are formed onto the side edges of each pivot arm 51 proximate bend 55. It should be noted that, with switch 11 disposed in its assembled form, tabs 59 and 61 of each movable contact 49 align within notches 29 and 31, respectively, of its corresponding terminal member 21. Accordingly, tabs 59 and 61 of each movable contact 49 contact its corresponding terminal member 21, thereby establishing a constant electrical current path between each terminal member 21 and its associated movable contact 49. Furthermore, aligning tabs 59 and 61 of each movable contact 49 within notches 29 and 31, respectively, of its corresponding terminal member 21 enables each movable contact 49 to pivot relative to its associated terminal member 21 without disrupting the constant electrical path therebetween, notches 29 and 31 of each terminal member 21 serving as the pivot point, or fulcrum, about which its associated movable contact 49 reciprocally pivots.

Each movable contact 49 can be clipped onto its associated arm 43 of contact bridge 41 in the following manner. Specifically, each movable contact 49 is slidably mounted onto the distal end of its associated arm 43 with pivot arm 51 and clip arm 53 disposed on opposite sides of arm 43. A semi-circular tab is sheared into pivot arm 51 of each movable contact 49 proximate bend 55. As each movable contact 49 is slidably mounted onto its associated arm 43, the semi-circular tab mates with an associated round hole 47 formed in contact bridge 41, each semicircular tab preferably being angularly offset to automatically snap into its associated round hole 47 in contact bridge 41 upon assembly.

An over-center mechanism 63 is disposed into interior cavity 19. Over-center mechanism 63 is connected to contact bridge 41 and serves to pivot contact bridge 41 between its first and second positions, as will be described further below.

Over-center mechanism 63 comprises an actuator arm 65, a pivot bushing 67 and a coiled spring 69.

Actuator arm 65 is an elongated member which is pivotally disposed within interior cavity 19 of housing 13. Actuator arm 65 includes a first end 71 and a second end 73, second end 73 being sized and shaped to extend through an opening formed in base 15 of housing 13, thereby enabling second end 73 to be externally accessible for holding a float, as will be described further below.

Pivot bushing 67 is a cap member which is shaped to include a rounded or semi-spherical depression 68. Depression 68 is sized and shaped to receive and engage the rounded first end 71 of actuator arm 65.

Coiled spring 69 includes a first end 75 and a second end 77. First end 75 of coiled spring 69 is fittingly disposed into pivot busing 67, thereby coupling coiled spring 69 to actuator arm 65 through busing 67. Second end 77 of coiled spring 69 is placed around a rearwardly projecting tab 46 which is integrally formed onto the approximate midpoint of cross-member 45 of contact bridge 41. Thus, coiled spring 69 is held in compression between cross-member 45 of contact bridge 41 and first end 71 of actuator arm 65. In this manner, actuator arm 65, pivot bushing 67 and coiled spring 69 together serve as an over-center mechanism for pivoting contact bridge 41 between its first position and its second position.

In use, switch 11 functions in the following manner to control the application of power from a power source to a sump pump motor in response to the rise and fall of the level of a liquid collecting in a sump. Second end 73 of actuator arm 65 is adapted to receive a floatation device, such as a conventional sump pump switch float, which remains on the top surface of the liquid.

Once the surface of the liquid rises to a predetermined level, the float draws second end 73 of actuator arm 65 upward. The upward displacement of second end 73 pivots actuator arm 65 which, in turn, causes the over-center mechanism 63 to snap pivot contact bridge 41 from its second position to its first position. As contact bridge 41 is snap pivoted to its first position, contact buttons 57 on movable contacts 49 are drawn into electrical contact with contact buttons 39 on fixed contact members 33, as seen most clearly in FIGS. 5 and 6, thereby establishing a current path from the power source to the sump pump motor. Upon receiving power from the power source, sump pump motor is activated.

To the contrary, once the surface of the liquid falls to a predetermined level, the float pulls second end 73 of actuator arm 65 downward. The downward displacement of second end 73 pivots actuator arm 65 which, in turn, causes the over-center mechanism 63 to snap pivot contact bridge 41 from its first position to its second position. As contact bridge 41 is snap pivoted to its second position, contact buttons 57 on movable contacts 49 are drawn out of electrical contact with contact buttons 39 on fixed contact members 33, as seen most clearly in FIG. 7, thereby opening the current path from the power source to the sump pump motor. Without receiving power from the power source, the sump pump motor is de-activated.

Broadly speaking, the various components of sump pump switch 11 which were described above are conventional. As can be appreciated, the novelty of the present invention relates to the inclusion and functionality of first and second wiper contacts 79-1 and 79-2, which will be described further in detail below.

Specifically, wiper contacts 79 are disposed into interior cavity 19 of housing 13 and are constructed of an electrically conductive material. As seen most clearly in FIGS. 2–5, each wiper contact 79 is a flat, unitary member which includes a horizontal leg 81 and a vertical leg 83 which are formed together about a bend 85 so as to provide wiper contact 79 with a generally L-shaped configuration.

Horizontal leg 81 of first wiper contact 79-1 is permanently affixed onto the inner surface of support arm 27 of first terminal member 21-1 using a rivet 87 or any other conventional fastening device. Vertical leg 83 of first wiper contact 79-1 is disposed to continuously contact and impart an inward force, as represented by arrow F in FIG. 3, onto bend 55 of movable contact 49-1.

Similarly, horizontal leg 81 of second wiper contact 79-2 is permanently affixed onto the inner surface of support arm 27 of second terminal member 21-2 using a rivet 87 or any other conventional fastening device. Vertical leg 83 of second wiper contact 79-2 is disposed to continuously contact and impart an inward force, as represented by arrow F' in FIG. 3, onto bend 55 of movable contact 49-2.

As can be appreciated, wiper contacts 79 serve two principal functions in switch 11.

As a first function, wiper contacts 79 serve to retain movable contacts 49 onto contact bridge 41. Specifically, each wiper contact 79 serves to continuously contact and impart an inward force onto bend 55 of its associated movable contact 49, thereby ensuring that its associated movable contact 49 remains in place on contact bridge 41, which is highly desirable.

As a second function, wiper contacts 79 provide a non-pivotal, non-articulating path through which current can travel between terminal members 21 and movable contacts 49. Specifically, each wiper contact 79 is sized and shaped to have a greater surface area than each terminal member 21 which, in turn, provides each wiper contact 79 with a lower impedance than each terminal member 21. As a result, the majority of current which passes from the power source to terminal members 21 will pass to movable contacts 49 through wiper contacts 79 rather than directly through the pivot points between terminal members 21 and movable contacts 49, which is highly desirable.

It should be noted that, in the absence of wiper contacts 79, electrical current which travels directly between terminal members 21 and movable contacts 49 is required to pass through a plurality of pivot points (i.e., between tabs 59 and 61 of each movable contact 49 and notches 29 and 31, respectively, of its corresponding terminal member 21). As can be appreciated, electrical current which travels through a plurality of pivot points renders the switch susceptible to arcing conditions between movable contacts 49 and terminal members 21, which is highly undesirable. As a consequence, the fact the switch 11 eliminates this propensity for arcing conditions by providing a pair of wiper contacts 79 through which the majority of current travels between movable contacts 49 and terminal members 21 serves to extend the life of switch 11 and render switch 11 more safe than conventional sump pump switches, which is highly desirable.

It should be noted that switch 11 is not limited to the particular construction and connection of wiper contacts 79. Rather, it is to be understood that wiper contacts 79 could have an alternative construction and/or could be alternatively connected to terminal members 21 and movable contacts 49 without departing from the spirit of the present invention.

Figure 8:
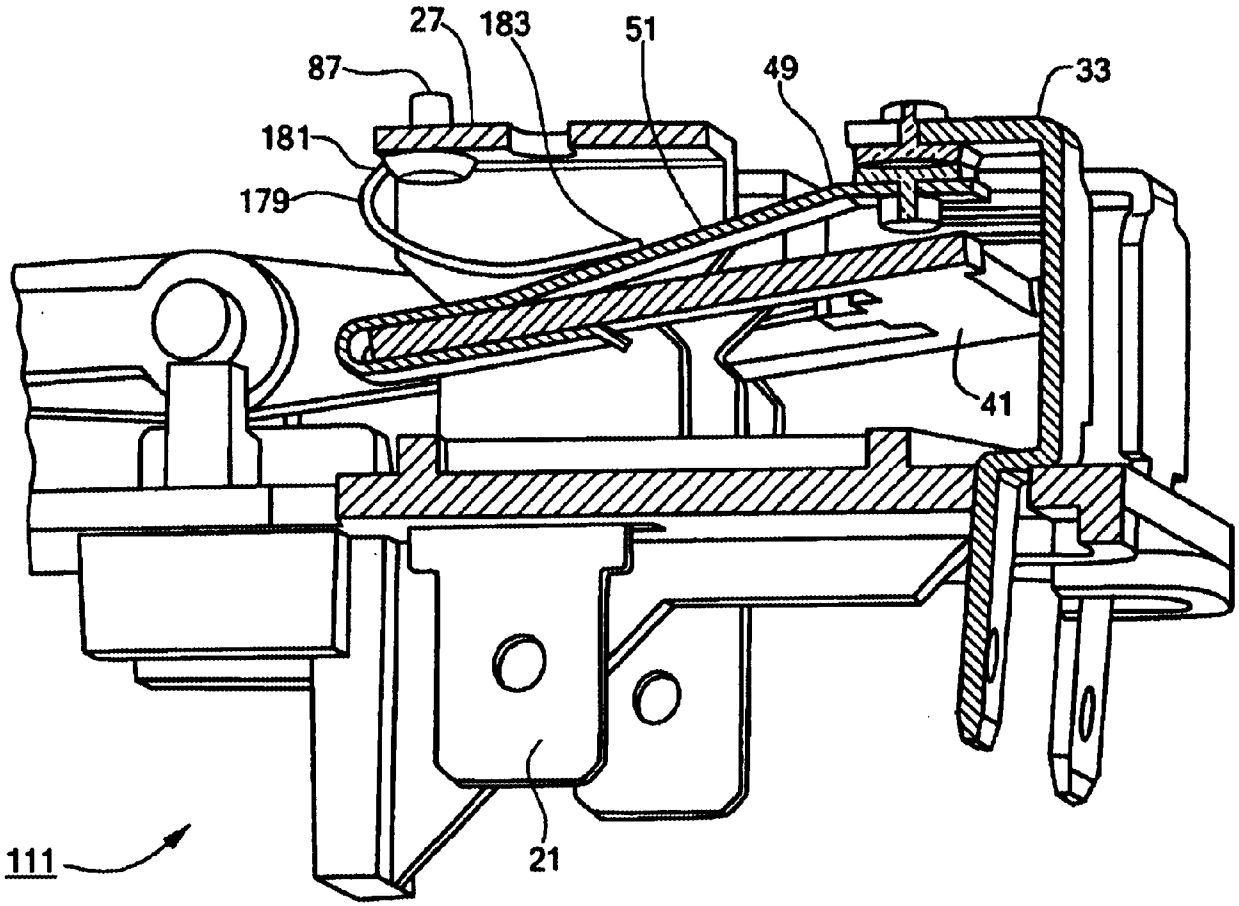
FIG. 8 is a fragmentary, side perspective section view of a second embodiment of a sump pump switch constructed according to the teachings of the present invention, the sump pump switch being shown with its housing, bushing and spring removed therefrom.

Specifically, referring now to FIG. 8, there is shown a second embodiment of a sump pump switch constructed according to the teachings of the present invention, the sump pump switch being represented generally by reference numeral 111. As can be appreciated, sump pump switch 111 is identical to sump pump switch 11 in all respects except sump pump switch 111 comprises a pair of wiper contacts 179 which differ in their construction and their connection to terminal members 21 and movable contacts 49 than wiper contacts 79 in switch 11.

Each wiper contact 179 has a thin strip, or tinsel lead, construction. As such, each wiper contact 179 is generally in the form of a wire which bent to contact both its corresponding terminal member 21 and its corresponding movable contact 49. Each wiper contact 179 comprises a first end 181 and a second end 183.

First end 181 of each wiper contact 179 is permanently affixed onto the inner surface of support arm 27 of its corresponding terminal member 21 using a rivet 87 or any other conventional fastening device. Second end 183 of each wiper contact 179 is permanently affixed onto the approximate mid-point of pivot arm 51 of its corresponding movable contact 49. Second end 183 is affixed onto the outer surface of pivot arm 51 using a conventional fastening device, such as a rivet, or using conventional welding techniques.

The versions of the present invention described above are intended to be merely exemplary and those skilled in the art shall be able to make numerous variations and modifications to it without departing from the spirit of the present invention. All such variations and modifications are intended to be within the scope of the present invention as defined in the appended claims. For example, it should be noted that the particular components which make up the aforementioned embodiments may be interchanged or combined to form additional embodiments.

It is claimed:

1. An electric switch comprising:

(a) an electrically insulated housing, (b) an electrically conductive terminal member disposed within said housing, (c) an electrically conductive contact member disposed within said housing, (d) an electrically conductive movable contact disposed in continuous pivotal contact with said terminal member, said movable contact selectively contacting said contact member, and (e) an electrically conductive wiper contact disposed within said housing, said wiper contact continuously connecting said terminal member to said movable contact.

2. The electric switch of claim 1 wherein said wiper contact has a lower impedance than said terminal member.

3. The electric switch of claim 1 wherein said wiper contact is a unitary member.

4. The electric switch of claim 1 wherein said contact member is fixedly disposed within said housing and comprises a pair of contact arms, one of said pair of contact members extending out of said housing for external electrical access thereto.

5. The electric switch of claim 1 wherein said housing comprises a base and a cover plate which together define an interior cavity.

6. An electric switch comprising:

(a) an electrically insulated housing, (b) a pair of electrically conductive terminal members disposed within said housing, (c) a pair of electrically conductive contact members disposed within said housing, (d) a pair of electrically conductive movable contacts disposed within said housing, each of said pair of movable contacts being disposed in continuous pivotal contact with a corresponding terminal member, each movable contact selectively contacting a corresponding contact member, and (e) a pair of electrically conductive wiper contacts disposed within said housing, each wiper contact continuously connecting a corresponding terminal member to a corresponding movable contact.

7. An electric switch comprising:

(a) an electrically insulated housing, (b) an electrically conductive terminal member disposed within said housing, (c) an electrically conductive contact member disposed within said housing, (d) an electrically conductive movable contact disposed in continuous pivotal contact with said terminal member, said movable contact selectively contacting said contact member, said movable contact including an elongated pivot arm and a clip arm which are connected together about a bend, and (e) an electrically conductive wiper contact disposed within said housing, said wiper contact being connected to said terminal member and to said movable contact.

8. The electric switch of claim 7 wherein said wiper contact comprises a horizontal leg and a vertical leg which are formed together about a bend.

9. The electric switch of claim 8 wherein said vertical leg of said wiper contact is disposed to continuously contact the bend of said movable contact.

10. The electric switch of claim 9 wherein said vertical leg of said wiper contact is disposed to continuously impart an inward force onto the bend of said movable contact.

11. The electric switch of claim 10 wherein the horizontal leg of said wiper contact is connected to the support arm of said terminal member.

12. The electric switch of claim 7 wherein said wiper contact has a tinsel lead construction and comprises a first end and a second end.

13. The electric switch of claim 12 wherein the first end of said wiper contact is connected to the support arm of said terminal member.

14. The electric switch of claim 13 wherein the second end of said wiper contact is connected to the pivot arm of the movable contact.

15. The electric switch of claim 7 wherein said terminal member is fixedly disposed within said housing and comprises a pair of contact arms which are connected by a support arm.

16. The electric switch of claim 15 wherein one of said pair of contact arms for said terminal member extends out of said housing for external electrical access thereto.

17. The electric switch of claim 16 wherein a notch is formed into each of the pair of contact arms in said terminal member.

18. The electric switch of claim 17 wherein the pivot arm of said movable contact is shaped to include a pair of tabs which are sized and shaped to pivot within the notches formed in said terminal member.

19. The electric switch of claim 18 further comprising an over-enter mechanism pivotally disposed within said housing for selectively drawing said movable contact into contact with said contact member.

20. The electric switch of claim 19 further comprising an electrically insulated contact bridge pivotally disposed within said housing.

21. The electric switch of claim 20 wherein said movable contact is pivotally mounted onto said contact bridge.

22. The electric switch of claim 21 wherein said movable contact is snap mounted onto said contact bridge.

23. The electric switch of claim 21 wherein said over-center mechanism is connected to said contact bridge, said over-center mechanism pivoting said contact bridge between a first position and a second position.

24. The electric switch of claim 23 wherein, with said contact bridge disposed in its first position, said movable contact is drawn into electrical contact with said contact member.

25. The electric switch of claim 24 wherein, with said contact bridge disposed in its second position, said movable contact is drawn out of electrical contact with said contact member.

* * * * *